US007060336B2

(12) United States Patent
Horii et al.

(10) Patent No.: US 7,060,336 B2
(45) Date of Patent: Jun. 13, 2006

(54) IMAGE RECEIVER MATERIAL

(75) Inventors: Akihiro Horii, Miyagi (JP); Hiroshi Kikuchi, Miyagi (JP); Yoshimasa Tanaka, Tokyo (JP); Shigeru Nagashima, Tokyo (JP)

(73) Assignees: Sony Corporation, Tokyo (JP); Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 10/618,415

(22) Filed: Jul. 11, 2003

(65) Prior Publication Data

US 2004/0023800 A1 Feb. 5, 2004

(30) Foreign Application Priority Data

Jul. 15, 2002 (JP) ..... 2002-205142
Mar. 19, 2003 (JP) ..... 2003-076524

(51) Int. Cl.
*B41M 5/40* (2006.01)

(52) U.S. Cl. ..... 428/32.81; 428/40.1; 428/42.1; 428/42.2; 428/43; 428/42.3

(58) Field of Classification Search ..... 428/32.81, 428/32.85, 40.1, 42.1, 42.2, 42.3, 43
See application file for complete search history.

(56) References Cited

U.S. PATENT DOCUMENTS 5,721,086 A * 2/1998 Emslander et al. ..... 430/126
5,882,754 A * 3/1999 Kuroyama et al. ..... 428/32.22
6,200,670 B1 * 3/2001 Hosoi et al. ..... 428/32.37
6,461,422 B1 * 10/2002 Yang et al. ..... 106/287.35
6,482,490 B1 * 11/2002 Hanahara et al. ..... 428/40.1
6,652,929 B1 * 11/2003 Moriya et al. ..... 428/32.12
2003/0228430 A1 * 12/2003 Tanaka et al. ..... 428/32.39

FOREIGN PATENT DOCUMENTS

EP 0 799 715 A 10/1997
EP 0 807 533 A 11/1997
EP 1 091 337 A 4/2001
JP 10-250240 * 9/1998
JP 2001-246865 * 9/2001

* cited by examiner

*Primary Examiner*—B. Shewareged
(74) *Attorney, Agent, or Firm*—Robert J. Depke; Trexler, Bushnell, Giangiorgi, Blackstone & Marr, Ltd.

(57) ABSTRACT

An image receiver material which, even when wound on a roll of a smaller diameter in a printer, an image receiver sheet is not peeled, such that the image receiver material is not susceptible to running troubles in a printer. To this end, there is provided a seal type image receiver material in which the image receiver material includes a separator including a release sheet base material and a release agent layer provided on its one surface and an image receiver sheet including a receiver sheet base material and an adhesive layer provided on its one surface. The separator and the image receiver sheet are layered together so that the separator and the image receiver sheet may be released from each other and so that the release agent layer of the separator faces the adhesive layer of the image receiver sheet. A half-cut is provided in the image receiver sheet. A stress relaxing portion is provided ahead of a half-cut provided in a direction subsequently perpendicular to the paper sheet feed/eject direction in the printer.

11 Claims, 4 Drawing Sheets

IMAGE RECEIVER MATERIAL

BACKGROUND OF THE INVENTION

1. Field of the Invention

This invention relates to an image receiver material, such as a sheet for heat transfer recording having a dye receiver layer receiving a dye transferred from the heat transfer sheet on melting or sublimation by heat, a sheet for ink jet recording having an ink receiver layer for receiving an ink jet ink, or a sheet for recording received toner. More particularly, this invention relates to a seal type image receiver material subjected to half-cut processing and specifically to a leaf or roll type image receiver material in which, even when the material is wound about a transport roll of a smaller diameter, the image receiver sheet is not peeled off such as to evade running troubles in the printer.

This application claims priority of Japanese Patent Application No. 2002-205142, filed on Jul. 15, 2002 and Japanese Patent Application No. 2003-076524, filed on Mar. 19, 2003, the entireties of which are incorporated by reference herein.

2. Description of Related Art

Recently, a thermal print system, in particular a thermal dye transfer print system which permits an extremely clear full-color image, is attracting attention. In the thermal dye transfer print system, a dye layer of the thermal transfer recording sheet is superposed on a dye receiver layer of a sheet for thermal transfer recording (printing sheet) containing a dye affixing type resin, and the superposed area is heated by e.g. a thermal head depending on a desired image to transcribe the dye of the dye layer to the dye receiver layer to form an image. Recently, a seal type sheet for thermal transfer recording, provided with an adhesive layer, is marketed in order to permit the sheet for thermal transfer recording from the transfer recording step to be freely affixed to various objects.

Such seal type sheet for thermal transfer recording includes a separator having a release agent layer on a release sheet base material, and an image receiver sheet, having an adhesive layer on one surface and a dye receiver layer on the other surface of the receiver sheet base material. The separator and the image receiver sheet are layered together so that the release agent layer and the adhesive layer face each other and so that the separator and the image receiver sheet may be peeled off at the release agent layer and the adhesive layer. In use, the image receiver sheet, carrying the image, is peeled off from the separator and affixed to various objects.

Such seal type sheet for thermal transfer recording is required to satisfy the following requirements: 1) high image recording concentration; 2) smooth transfer recording; and 3) facilitated accurate peeling of the image receiver sheet from the separator after recording the image by transfer recording. It should be noted that, as for peeling, it is known from Japanese Laying-Open Patent Publication 64-82988, page 1, FIGS. 1 and 2 to perform half-cut processing on the image receiver sheet or on the separator in order to permit facilitated peeling of an area carrying the transcribed image.

An adhesive label sheet of a simplified structure, in which plural labels, each having an adhesive layer, are provisionally bonded from the side adhesive layer to the release sheet, is also known and has been used for a long time. One of the manufacturing methods for the adhesive label sheets is such a method in which an adhesive sheet is provisionally bonded to the entire surface of the release sheet, and a label area only is die-cut, so as not to cut the release sheet, to provide a half-cut to remove an unneeded portion. In the case of this manufacturing method, it is proposed in Japanese Laying-Open Patent Publication 50-155220, pages 1 to 3, to provide a half-cut line, in other than the portion of the adhesive sheet in register with the label, in order to prevent the label from being partially peeled off when removing the unneeded portion and in order to prevent the entire label from being peeled off along with the unneeded portion.

However, with the conventional half-cut processing, such as is disclosed in the Japanese Laying-Open Patent Publication 64-82988, difficulties are encountered in achieving "smooth transfer recording in a small-sized printer featured by high speed printing" and "facilitated peel-off of the image receiver sheet, carrying the image after transfer recording, from the separator" in combination. Specifically, in order to provide for facilitated peeling of the image receiver sheet, carrying the sheet, from the separator, the half-cut is deepened, the adhesive layer is lowered in its bonding strength level or the release agent layer is improved in releasing properties. However, if, when the image receiver material is wound about a transport roll of a smaller diameter in the printer at the time of feeding/ejecting the paper sheet before and after transfer recording, the image receiver sheet of the sheet for thermal transfer recording is high in toughness, the image carrying area tends to be peeled off from the half-cut area (half-cut peel-off) to render it impossible to prepare a desired image. In the worst case, running troubles, for example, paper is chocked, are produced. Thus, in order to make the half-cut less liable to be peeled off even in case the sheet for thermal transfer recording is wound on the roll of a smaller diameter, attempts are being made to make the half-cut shallower, to increase the bonding strength of the adhesive layer or to degrade the releasing properties of the release agent layer. However, in these cases, there persists the possibility that, after thermal transfer recording, the image receiver sheet, now carrying an image, can hardly be released from the separator. Although it is contemplated to lower the tenacity of the image receiver sheet, the sheet for thermal transfer recording tends to lose its tenacity, thus lowering the image quality. Additionally, there is also a possibility that the sheet for thermal transfer recording becomes unable to withstand the pressure applied from the thermal head and is thereby warped to produce running troubles.

On the other hand, in a manufacturing method for an adhesive label, disclosed in Japanese Laying-Open Patent Publication 50-155200, the peel-off of the adhesive label only is at issue, while the loading of the adhesive label on the thermal transfer recording printer, an ink jet printer or a laser printer to form an image is not presupposed. The problem of half-cut peel-off in the course of the image formation is not recognized whatsoever in this publication. Consequently, no measures have been contemplated for providing a certain type of a half-cut line in a necessary portion other than the label equivalent portion of the adhesive sheet for possibly avoiding the problem of half-cut peel-off in the sheet for thermal transfer recording in the printer.

This problem equally occurs in other types of the seal type image receiver material, for example, a sheet for ink jet recording or a toner receiver recording sheet.

SUMMARY OF THE INVENTION

It is therefore an object of the present invention to overcome the above-mentioned problems of the related art and to provide an image receiver material in which the image receiver sheet is not peeled off even when the material is wound about a transport roll of a smaller diameter, such that no running troubles are produced in the printer.

The present inventors have found that, by providing a stress relaxing part ahead of the half-cut, provided extending in a direction substantially perpendicular to the paper sheet feed/eject direction in the printer, for relaxing the stress produced in the image receiver sheet in the printer, it is possible to relax the load stress ascribable to the toughness of the image receiver sheet to prevent the half-cut peel-off during paper sheet feed/eject operations before and after the image formation to assure smooth image formation. The present inventors have also found that if, when the image receiver material, having a dummy half-cut, as a stress relaxing part, extending in a direction substantially parallel to the half-cut, is arranged as an elongated roll, the distance between the half-cut and the dummy half-cut is set to 2/1 to 1/10 of the diameter of the transport roll of the smallest diameter in the printer, it is possible to relax the load stress ascribable to the toughness of the image receiver material to prevent half-cut peel-off during paper sheet feed/eject operations before and after image formation to assure smooth image formation.

In one aspect, the present invention provides an image receiver material of the seal type comprising a separator including a release sheet base material and a release agent layer provided on one surface thereof, and an image receiver sheet including a receiver sheet base material and an adhesive layer provided on one surface thereof, wherein the separator and the image receiver sheet are layered releasably from each other, with the release agent layer of the separator facing the adhesive layer of the image receiver sheet, and wherein the image receiver sheet is provided with a half-cut in a direction substantially perpendicular to the feed/eject direction for a paper sheet of the image receiver material in a printer, and with stress relaxing means ahead of the half-cut.

The stress relaxing part may be enumerated by a dummy half-cut, a quarter cut, perforations and skimming (removal of a certain predetermined portion of the image receiver sheet other than the image forming area surrounded by the dummy half-cut). In particular, the dummy half-cut, provided substantially parallel to the half-cut, provided in turn substantially perpendicular to the paper sheet feed/eject direction in the printer, is desirable by reason of ease in forming.

In another aspect, the present invention also provides an image receiver material of the seal type comprising a separator including a release sheet base material and a release agent layer provided on one surface thereof, and an image receiver sheet including a receiver sheet base material and an adhesive layer provided on one surface thereof, wherein the separator and the image receiver sheet are layered releasably from each other with the release agent layer of the separator facing the adhesive layer of the image receiver sheet, and wherein the image receiver sheet is provided with a half-cut in a direction substantially perpendicular to the feed/eject direction for a paper sheet of the image receiver material in a printer, and with a dummy half-cut substantially parallel to the half-cut, with the distance between the half-cut and the dummy half-cut being 2/1 to 1/10 of the roll diameter of a transport roll of the minimum diameter in the printer.

In the image receiver material of the present invention, the depth of each of the half-cut and the dummy half-cut is 100 to 150% of the thickness of the image receiver sheet and the width of the dummy half-cut is at least 40% of the image receiver material.

With the image receiver material, an image may directly be formed on the receiver sheet base material of the image receiver sheet thereof by a thermal transfer recording printer, an ink jet printer or a laser printer. If the image receiver material is used as a sheet for thermal transfer recording, it is preferred that a dye receiver layer receiving a dye transcribed on being melted or sublimated by heat is formed on the surface of the receiver sheet base material of the image receiver sheet opposite to the adhesive layer. On the other hand, if the image receiver material is used as a sheet for ink jet recording, it is preferred that an ink receiver layer receiving an ink jet ink is formed on the surface of the receiver sheet base material of the image receiver sheet opposite to the adhesive layer.

DESCRIPTION OF THE PREFERRED EMBODIMENTS

Figure 1:
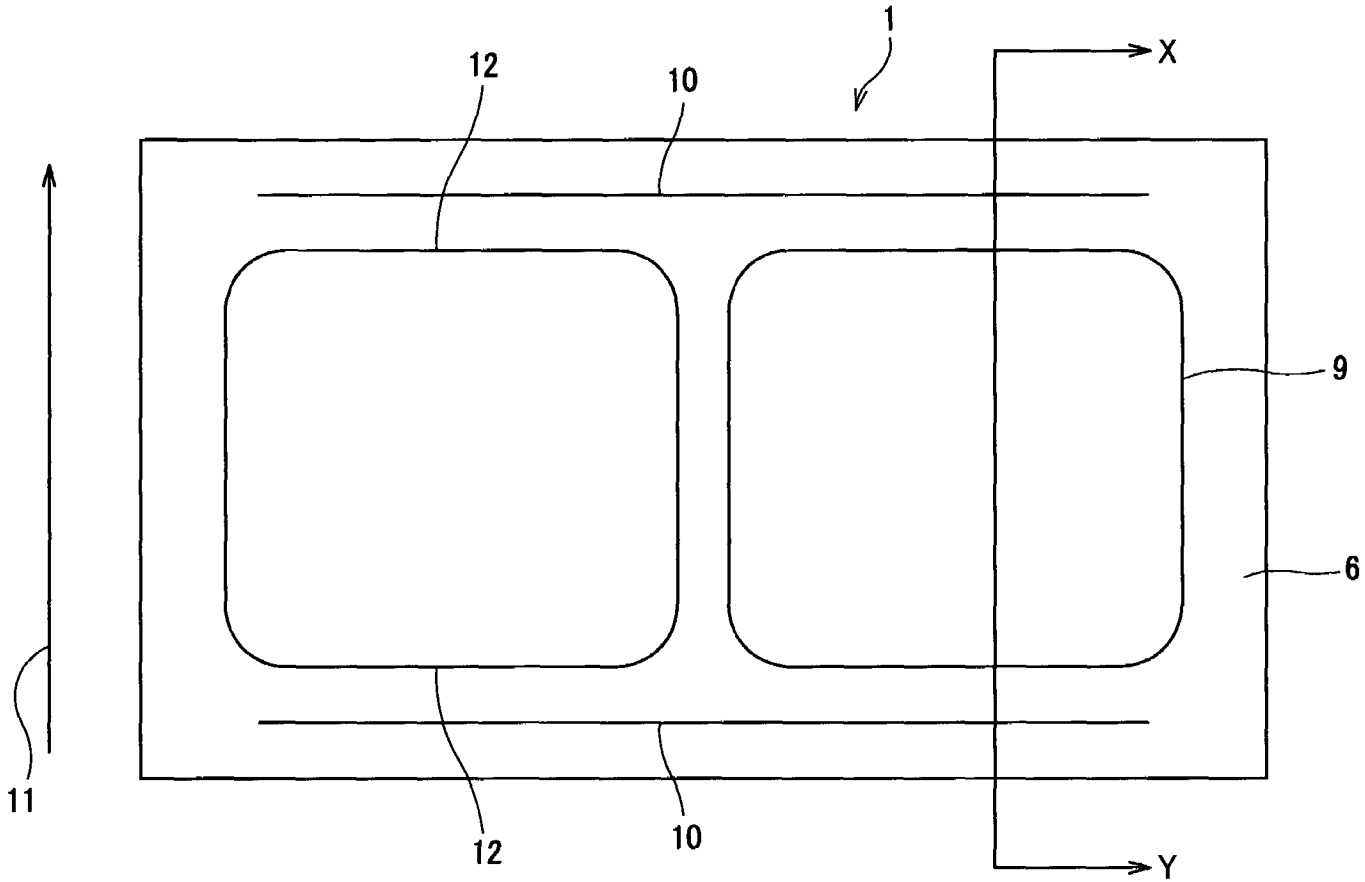
FIG. 1 is a plan view showing a sheet for thermal transfer recording, as typical of an image receiver material of the present invention.

Referring to the drawings, preferred embodiments of a sheet for thermal transfer recording, as typical of an image receiver material of the present invention will be explained in detail.

FIG. 1 depicts a plan view of a sheet for thermal transfer recording 1, as typical of an image receiver material of the present invention. On a surface of the sheet for thermal transfer recording 1 towards a dye receiver layer 6, a half cut 9 is formed to a rectangular profile to permit an image receiver sheet to be peeled off to a rectangular shape. In a portion of the half-cut 9, lying in a direction 11 substantially perpendicular to the direction of feeding and ejecting the sheet in a printer, a dummy half-cut 10 is provided, as a stress relieving portion, at least ahead of a half-cut 12 and substantially parallel to the half-cut 12. The layered structure of the sheet for thermal transfer recording 1 includes a separator 4, made up by a release sheet base material 2 and a layer of a releasing agent 3, provided on one side of the release sheet base material 2, and an image receiver sheet 7, releasably layered on the separator 4. The image receiver sheet 7 is made up by a receiver sheet base material 5, on one surface of which is provided a dye receiver layer 6 and on the other surface of which is provided an adhesive layer 8. The image receiver sheet 7 is layered on the separator so that the layer of the releasing agent 3 faces the adhesive layer 8 (see FIG. 2, which is the X-Y cross-sectional view of FIG. 1). Due to this structure of the sheet for thermal transfer recording 1 of the present invention, the image receiver sheet 7, carrying the image, may readily be peeled from the separator 4. Moreover, as shown in FIG. 3, if, during feed/eject operations of the sheet for a printer, the sheet for thermal transfer recording 1 is wound on a transport roll 13 of a smaller diameter, it is possible to prevent half-cut peeling during the sheet feed/eject operations, because the load stress produced due to the toughness of the sheet for thermal transfer recording 1 wound on the small-diameter transport roll may be relaxed by the dummy half-cut 10 operating as a stress relaxing part.

Figure 3:
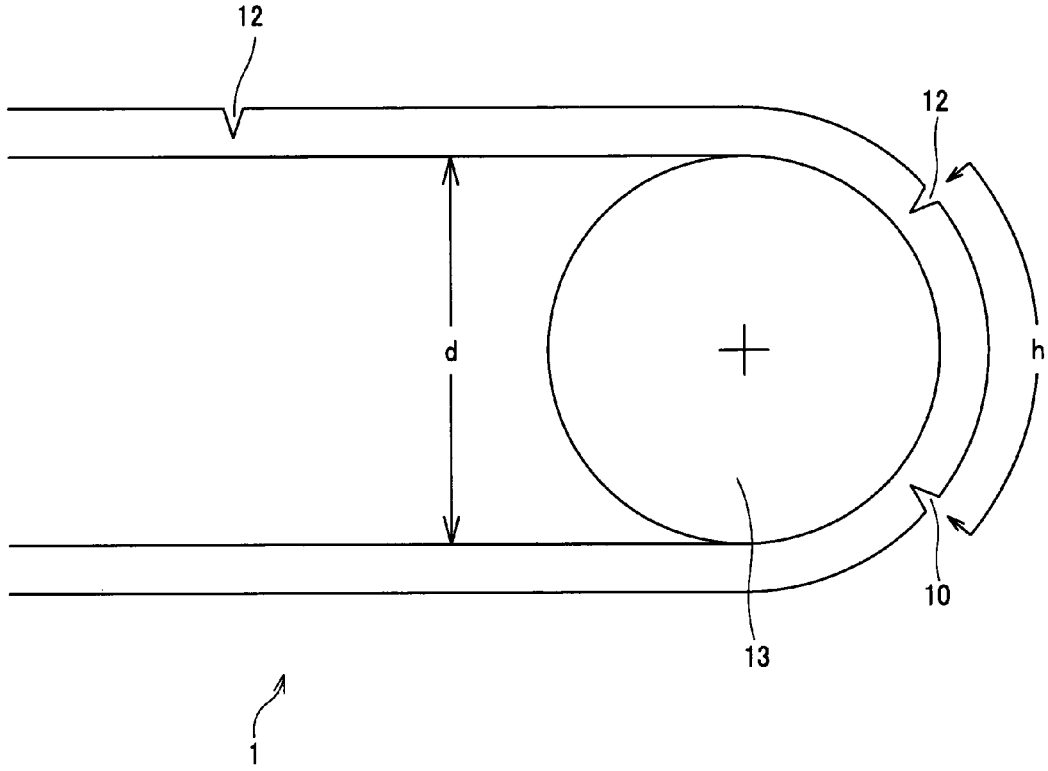
FIG. 3 shows the relative positions of a sheet for thermal transfer recording, as typical of an image receiver material of the present invention, and a transport roll in a printer.

The distance h between the half-cut 12 and the dummy half-cut 10 is preferably 2/1 to 1/10 and more preferably 1/1 to 1/5 of the diameter d of the transport roll of the smallest diameter among the transport rolls within the printer (FIG. 3). The reason is that, if the distance h is larger than 2/1 of the diameter of the transport roll of the smallest diameter among the transport rolls within the printer, the load stress produced due to the stiffness of the sheet for thermal transfer recording for this roll diameter is applied not on the dummy half-cut 10 but on the half-cut 12, with the result that the half-cut is liable to be peeled off, and that, if the distance h is smaller than 1/10, the load stress produced due to the stiffness of the sheet for thermal transfer recording for this diameter is relaxed only insufficiently, with the result that the half-cut is liable to be peeled off. As for the diameters of the transport rolls in the printer, a smaller diameter of the roll of the smallest diameter is more favorable in achieving the effect of the present invention. The diameter of the smallest diameter roll is routinely 5 to 50 mm. Thus, in this case, the distance h between the half-cut 12 and the dummy half-cut 10 is preferably 1 to 50 mm and more preferably 1 to 20 mm.

The width of the dummy half-cut 10 is preferably at least 40% and more preferably at least 50% and less than 100% of the width of the sheet for thermal transfer recording 1 in a direction perpendicular to the sheet feed/eject direction 11 in the printer. The reason is that, if the width of the dummy half-cut is less than 40%, the load stress due to the stiffness of the sheet for thermal transfer recording for this roll diameter is relaxed only insufficiently when the sheet is wound on a transport roll of a smaller diameter in the printer, with the result that the half-cut is liable to be peeled off, and that, if the width of the dummy half-cut is 100%, that is equal to the full width of the roll, the risk is high that an image receiver sheet 7 is peeled off from the separator 4 on the site of the dummy half-cut 10.

It is sufficient that the depth of the half-cut 12 and that of the dummy half-cut 10 are such that the image receiver sheet 7 may be satisfactorily peeled off from the separator 4. For example, cutting is preferably to the receiver sheet base material 5, more preferably to 100 to 150% and most preferably to 100 to 120% of the image receiver sheet 7. The reason is that, if the depth is too shallow, it tends to be difficult to peel off the image receiver sheet 7, carrying the image, and the separator 4 following transfer recording, whereas, if the depth is too deep, the heating of the thermal head at the time of printing tends to be nonuniform to produce an image irregularity.

The receiver sheet base material 5, used in the present invention, may be enumerated by paper sheets, such as a coat paper sheet, an art paper sheet or a quality paper sheet, laminated paper sheet, comprised of a base paper sheet and resin, such as polyethylene, a laminated thereon, and a film of polyester, nylon or polyolefin, such as polypropylene. Two or more of these paper sheets or films may be layered together. The receiver sheet base material 5 may be formed of a foamed material or provided with a foamed layer.

When the receiver sheet base material 5 is formed from pulp by a paper-making technique, there is no particular limitation to the pulp starting material. Thus, wood pulp, such as chemical pulp or mechanical pulp of a needle-leaf tree or a broad leaf tree, or a synthetic pulp, prepared from polyethylene or polypropylene, as a feedstock, may be used, either alone or in combination. These pulp materials may be added to various fibers, including organic fibers, such as acrylic fibers, rayon fibers, phenolic fibers, polyamide fibers or polyester fibers, and inorganic fibers, such as glass fibers, carbon fibers or alumina fibers. Meanwhile, if these non-pulp fibers are used in combination, the amount of the pulp material is desirably not less than 50 wt % in order to maintain the paper-making properties at a practically acceptable level, whereby the receiver sheet base material exhibiting superior formation and strength may be produced.

The release sheet base material 2, used in the present invention, may be enumerated by glassine paper sheet, a polylaminate paper sheet, composed of a quality paper sheet and e.g. polyethylene, laminated thereon, a synthetic paper sheet, composed mainly of polypropylene, and a polyethylene terephthalate film.

A layer of a release agent 3, provided on the separator 4, may be formed by coating e.g. a silicone-based releasing agent on one surface of the release sheet base material 2 by for example a gravure coater or a bar coater, and drying the resulting product in situ. The coating quantity of the solid content of the releasing agent or the thickness of the as-dried layer of the releasing agent is preferably 0.3 to 1.5 g/m$^2$ or 0.2 to 2.0 μm, respectively, and more preferably 0.5 to 1.2 g/m$^2$ or 0.5 to 1.5 μm, respectively. If the coating quantity of the solid content of the releasing agent or the thickness of the as-dried layer of the releasing agent is less than 0.3 g/m$^2$ or 0.2 μm, respectively, the release agent layer 3 tends to be fluctuated in peel-off propertiess. If the coating quantity of the solid content of the releasing agent exceeds 1.5 g/m$^2$ or the thickness of the as-dried layer exceeds 2.0 μm, the releasing agent tends to be saturated to give rise to economic demerits.

An adhesive layer 8 of the image receiver sheet 7 may be formed by applying an adhesive, such as an acrylic-, a synthetic rubber-, a natural rubber- or a silicone-based adhesive, to one surface of the receiver sheet base material 5, and drying the resulting product. Alternatively, the adhesive layer 8 may be provided on the surface of the release agent layer 3 of the separator 4 and the receiver sheet base material 5 may be bonded from the opposite surface of the dye receiver layer 6. If necessary, the adhesive may be added by a cross-linking agent or a filler.

The adhesive layer 8 is adjusted so that the peel-off power between the image receiver sheet 7 and the separator 4 amounts preferably to 50 to 250 mN/20 mm and more preferably to 100 to 200 mN/20 mm in case the peel-off power is measured at a peel-off speed of 300 mm/min, for the reason that, if the peel-off power is less than 50 mN/20 mm, the image receiver sheet 7 tends to be peeled off when scrubbed under the effect of the inner structure of the printer, whereas, if the peel-off power is larger than 250 mN/20 mm, the image receiver sheet 7 is hardly separable from the separator 4. It is noted that the peel-off power is defined as a load stress in mN/20 mm necessary to peel off the image receiver sheet 7 of the sheet for thermal transfer recording, cut to a width of 20 mm, from the separator 4 at a predetermined speed at a pull angle of 90 degree.

As means for adjusting the peel-off power of the adhesive layer 8, the types of the cross-linking agent and the releasing agent and, if necessary, the cross-linking agent and the filler, as well as the coating quantity or the thickness of the adhesive layer, may be properly set. The coating quantity or the as-dried thickness of the adhesive layer preferably may be 10 to 30 g/m$^2$ or 5 to 40 μm, respectively, and more preferably may be 10 to 20 g/m$^2$ or 8 to 20 μm, respectively. If the coating quantity or the as-dried thickness of the adhesive layer is less than 10 g/m$^2$ or less than 5 μm, respectively, the adhesive power is unstable. If the coating quantity or the as-dried thickness of the adhesive layer exceeds 30 g/m$^2$ or 40 μm, respectively, the adhesive layer tends to be exuded on pressure application.

As the resins making up the dye receiver layer 6, dyeable resins, such as thermoplastic resins, thermosetting resins or UV curable resins, may be used. For example, polyester resins, polycarbonate resins, polyvinyl acetate resins, polyamide resins, polyvinyl chloride resins, polystyrene resins, styrene acrylate resins, polyurethane resins, poly(meth)acrylate resins, urea resins, cellulose resins, polyvinyl alkyl acetal resins or any of the above-mentioned copolymers may be used, either alone or in combination.

Turning to the weight average molecular weight of these dyeable resins, if the molecular weight is too small, the resin tends to be brittle, such that coating properties tend to be lowered at the time of forming the dye receiver layer 6. If the molecular weight is excessive, the coating mixture containing the dyeable resin is increased in viscosity to lower the ease in coating. Consequently, the weight average molecular weight is preferably 10,000 to 1,000,000 and more preferably 100,000 to 1,000,000.

There is no particular limitation to the method for manufacturing the dyeable resins used, such that the dyeable resins may be manufactured by any suitable polymerization methods, such as suspension polymerization, block polymerization, solution polymerization or emulsion polymerization.

A curing agent may be used for the dye receiver layer 6 for improving its film characteristics or thermal resistance. For example, epoxy-based resins or an isocyanate-based curing agent may be used. In particular, non-yellowing type poly-functional isocyanate compounds are preferred. These poly-functional isocyanate compounds may be enumerated by, for example, hexamethylene diisocyanate (HDI), xylene diisocyanate (XDI) and toluene diisocyanate (TDI). Additionally, biuret or adduct type polyisocyanate compounds may be used. These may be used alone or in combination.

The dye receiver layer 6 may be added by inorganic pigments, such as titanium oxide, calcium carbonate or phosphorescent whiteners for improving whiteness.

The dye receiver layer 6 may be added by releasing agents, which may be enumerated by, for example, silicone oils, such as methylstyrene modified silicone oil, olefinic modified silicone oil, polyether modified silicone oil, fluorine modified silicone oil, epoxy modified silicone oil, carboxy modified silicone oil, amino modified silicone oil, or carbinol modified silicone oil, and fluorine based releasing agents.

Moreover, anti-electrifying agents may be applied to the dye receiver layer 6 in order to prevent static charges from being generated in the printer during running. The anti-static agents may be one of a variety of surfactants, exemplified by, for example, an cationic surfactant (e.g. quaternary ammonium salts or polyamine derivatives), anionic surfactants (e.g. alkylbenzene sulfonate or alkyl sulfate sodium salts), ampho-ion surfactants and nonionic surfactants. These anti-static agents may be added to the dye receiver layer 6 or coated on its surface.

The dye receiver layer 6 may be added by plasticizers as necessary. The plasticizers may be enumerated by phthalates, adipates, trimellates, pyromellates and poly-valeric phenolic esters. For improving preservation properties, UV absorbers or anti-oxidants may be added as appropriate. The UV absorbers may be enumerated by for example benzophenone, diphenyl acrylate or benzotriazole based UV absorbers, while the anti-oxidants may be enumerated by for example phenolic, organic sulfur or phosphoric acid based anti-oxidants.

If the dye receiver layer 6 is too thin, the quantity of the dye that can be accommodated is decreased, as a result of which the dye may be localized on the surface of the dye receiver layer 6 to deteriorate the light fastness, whereas, if the dye receiver layer 6 is too thick, it is difficult to acquire the amount of heat necessary for transfer recording of the dye, such that the maximum concentration of the transcribed image tends to be lowered. In this consideration, the thickness of the dye receiver layer 6 is preferably 2 to 20 μm and more preferably 3 to 10 μm.

There is no limitation to the method for forming the dye receiver layer 6. It is sufficient if a coater, such as bar coater, gravure coater, comma coater, blade coater or air knife coater is used to apply a coating solution for producing the dye receiver layer, as conventionally, and the coating thus formed is then dried in situ.

Figure 2:
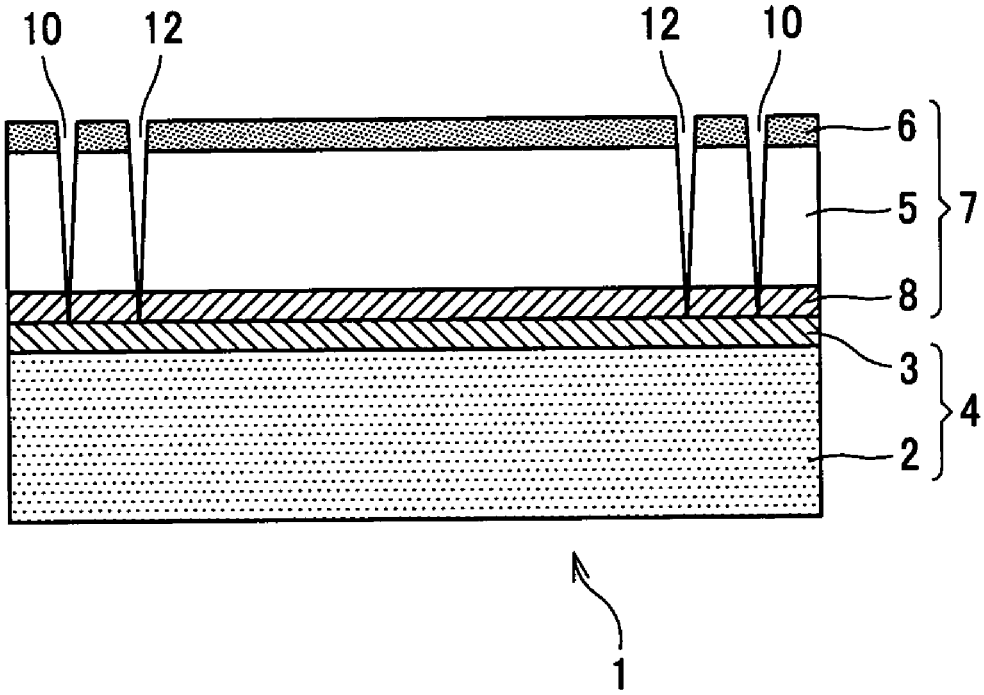
FIG. 2 is a cross-sectional view showing a sheet for thermal transfer recording, as typical of an image receiver material of the present invention.

If the image receiver material of the present invention is used as a sheet for ink jet recording, it is sufficient to substitute an ink receiver layer receiving the ink jet ink for the dye receiver layer 6 shown in FIG. 2. This ink receiver layer may be of the same type as the ink receiver layer of the known printing sheet for ink jet printing, and may be enumerated by a film obtained on adding a filler as necessary to an ink receiver resin and on forming the resulting product into a film.

The image receiver material, which is the image receiver sheet 7 of FIG. 2 not including the dye receiver layer 6, may preferably be used in forming a toner image by a laser printer.

Figure 4A:
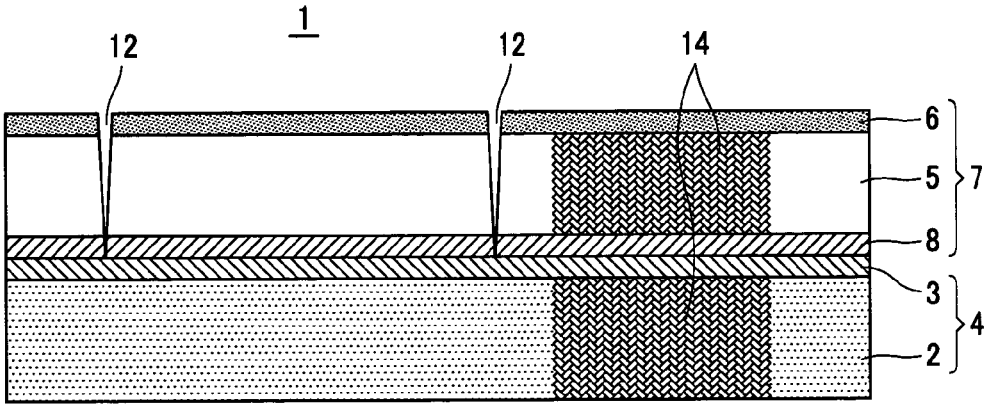
FIGS. 4A to 4C are cross-sectional views showing a sheet for thermal transfer recording, as typical of an image receiver material of the present invention.
Figure 4B:
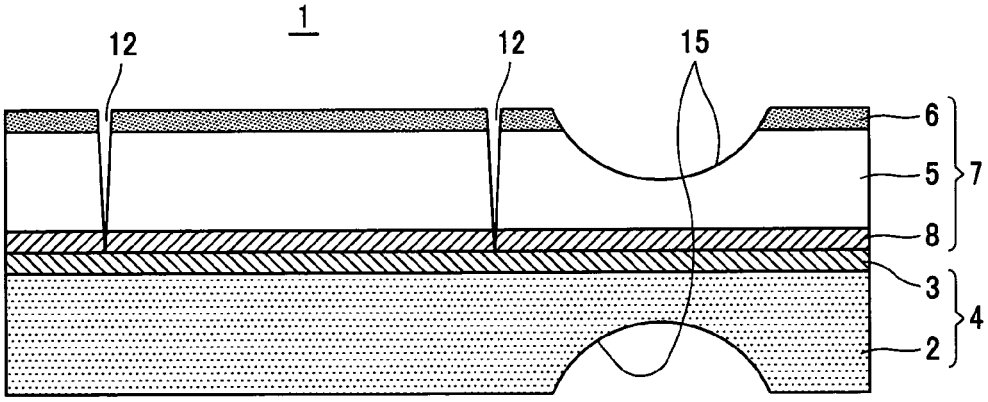
Figure 4C:
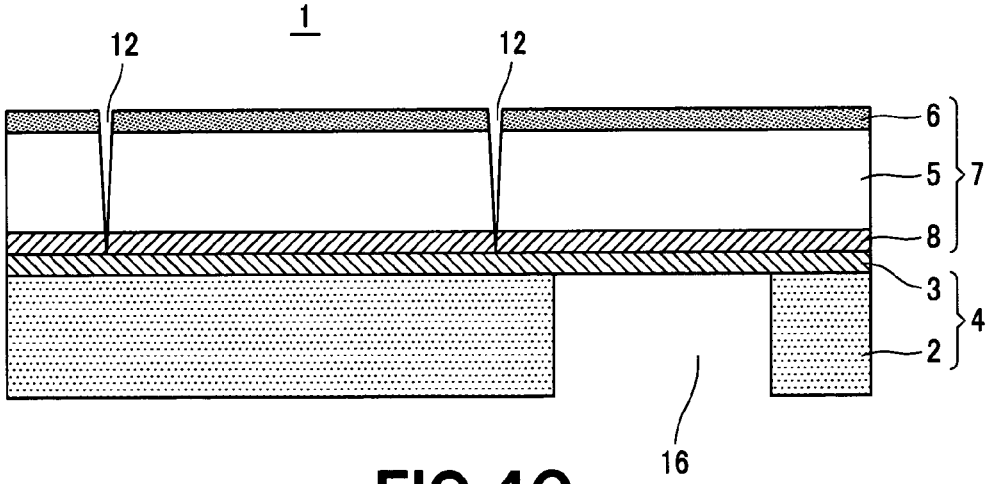

In the embodiment of the present invention, shown in FIGS. 1 to 3, the dummy half-cut 10 is used as an example of a stress relaxing means to be provided ahead of the half-cut 12. However, the stress relaxing means is not limited to this shape of the dummy half-cut. For example, as shown in FIG. 4A, a stress relaxing means 14, having toughness on the order of 5 to 50% of that of the base material, may be provided ahead of the half-cut 12, in order to achieve the object of the present invention. A stress relaxing means 14 may be formulated by changing the type of the release sheet base material 2 and/or the receiver sheet base material 5, or by increasing the foaming ratio of the stress relaxing means if the release sheet base material 2 or 5 is formed of a foaming type base material. Additionally, the thickness of the stress relaxing means 14 may be on the order of 5 to 70% of that of the other area, in order to achieve the object of the present invention, as shown in FIG. 4B. In the embodiment shown in FIGS. 1 to 3, the dummy half-cut 10 is provided in the same surface as that where the half-cut 12 is formed. Alternatively, the bulk material of the separator 4 may be removed partly or entirely, by way of forming a stress relaxing means 16, ahead of the half-cut 12, in the vicinity of the release sheet base material 2, as shown in FIG. 4C.

EXAMPLES

The present invention is now explained with reference to specified Examples thereof. It should be noted that the present invention is not limited to these Examples.

For evaluating the running properties, a sublimation heat transfer recording roll type printer UP-DR100, manufactured by one of the present Assignee, Sony Corporation, was used. The diameter of the smallest diameter roll in the running process of the sheet for thermal transfer recording was 10 mm.

Reference Example

Preparation of a Seal Type Sheet for Thermal Transfer Recording (Roll Type)

<Preparation of Image Receiver Layer>

(Formation of Receiver Layer)

A foamed film 50 μm thick, prepared using polyethylene terephthalate as a main component (manufactured by TORAY under the product number of 50E63S), was used as a receiver sheet base material, and a paint—1 of the composition of Table 1 was coated by gravure coating on one surface thereof to a dry thickness of 5 μm and dried in situ to form the dye receiver layer.

TABLE 1

| components | mass part |
|---|---|
| methyl methacrylate resin (product number: MH101-5, manufactured by FUJIKURA KASEI) | 100 |
| silicone oil (product number: SF8427 manufactured by TORAY DOW CORNING) | 5 |
| XDI-based polyisocyanate (product number: D110N manufactured by TAKEDA CHEMICALS INDUSTRIES, LTD.) | 10 |
| toluene/methylethylketone (1/1) mixed solvent | 485 |

(Formation of Adhesive Layer)

On a surface of the receiver sheet base material opposite to the surface carrying the dye receiver layer 6, an adhesive (manufactured by TOYO INK under the product number of OLIBAIN BPS-4891) was applied to a dry thickness of 15 μm and dried in situ to form an adhesive layer, thereby to form an image receiver sheet. The thickness of this image receiver sheet was 70 μm.

<Preparation of Separator>

Using a film, mainly composed of polyester, and having a foamed structure and a thickness of 100 μm (manufactured by MITSUBUSHI POLYESTER FILM CORPORATION under the product number of KS-830), as release sheet base material, a silicone-based releasing agent (manufactured by SHIN-ETSU CHEMICAL CO. LTD. under the product number of KS-830), was coated by a dry coating method, to a dry thickness of 0.5 μm, on one surface of the release sheet base material, and dried, to form a layer of a releasing agent, thereby to form the separator.

<Preparation of Seal Type Sheet for Thermal Transfer Recording (Roll Type)>

The layer of the releasing agent of the separator, obtained as described above, was superposed on and bonded to the adhesive layer of the image receiver sheet, to form a seal type sheet for thermal transfer recording. The seal type sheet for thermal transfer recording, thus obtained, was cut to a width of 127 mm and a length of 15 m to produce a seal type sheet roll for thermal transfer recording ①.

Example 1

A discontinuous half-cut was provided on the dye receiver layer of the image receiver sheet of the seal type sheet roll for thermal transfer recording ①, and a dummy half-cut was formed parallel to the width-wise direction of the half-cut. The depth of the half-cut and that of the dummy half-cut were set to 70 μm (100% of the thickness of the image receiver sheet), the distance between the half-cut and the dummy half-cut was set to 10 mm (1/1 of the smallest roll diameter) and the length of the dummy half-cut was set to 63.5 mm (50% of width).

Example 2

A discontinuous half-cut was provided on the dye receiver layer of the image receiver sheet of the seal type sheet roll for thermal transfer recording ①, and a dummy half-cut was formed parallel to the width-wise direction of the half-cut. The depth of the half-cut and that of the dummy half-cut were set to 84 μm (120% of the thickness of the image receiver sheet), the distance between the half-cut and the dummy half-cut was set to 10 mm (1/1 of the smallest roll diameter) and the length of the dummy half-cut was set to 63.5 mm (50% of width).

Example 3

A discontinuous half-cut was provided on the dye receiver layer of the image receiver sheet of the seal type sheet roll for thermal transfer recording ①, and a dummy half-cut was formed parallel to the width-wise direction of the half-cut. The depth of the half-cut and that of the dummy half-cut were set to 70 μm (100% of the thickness of the image receiver sheet), the distance between the half-cut and the dummy half-cut was set to 2 mm (1/5 of the smallest roll diameter) and the length of the dummy half-cut was set to 63.5 mm (50% of width).

Example 4

A discontinuous half-cut was provided on the dye receiver layer of the image receiver sheet of the seal type sheet roll for thermal transfer recording ①, and a dummy half-cut was formed parallel to the width-wise direction of the half-cut. The depth of the half-cut and that of the dummy half-cut were set to 70 μm (100% of the thickness of the image receiver sheet), the distance between the half-cut and the dummy half-cut was set to 10 mm (1/1 of the smallest roll diameter) and the length of the dummy half-cut was set to 126 mm (99% of width).

Example 5

A discontinuous half-cut was provided on the dye receiver layer of the image receiver sheet of the seal type sheet roll for thermal transfer recording ①, and a dummy half-cut was formed parallel to the width-wise direction of the half-cut. The depth of the half-cut and that of the dummy half-cut were set to 70 μm (100% of the thickness of the image receiver sheet), the distance between the half-cut and the dummy half-cut was set to 20 mm (2/1 of the smallest roll diameter) and the length of the dummy half-cut was set to 63.5 mm (50% of width).

Example 6

A discontinuous half-cut was provided on the dye receiver layer of the image receiver sheet of the seal type sheet roll for thermal transfer recording ①, and a dummy half-cut was formed parallel to the width-wise direction of the half-cut. The depth of the half-cut and that of the dummy half-cut were set to 70 μm (100% of the thickness of the image receiver sheet), the distance between the half-cut and the dummy half-cut was set to 1 mm (1/10 of the smallest roll diameter) and the length of the dummy half-cut was set to 63.5 mm (50% of width).

Example 7

A discontinuous half-cut was provided on the dye receiver layer of the image receiver sheet of the seal type sheet roll for thermal transfer recording ①, and a dummy half-cut was formed parallel to the width-wise direction of the half-cut. The depth of the half-cut and that of the dummy half-cut were set to 70 μm (100% of the thickness of the image receiver sheet), the distance between the half-cut and the dummy half-cut was set to 10 mm (1/1 of the smallest roll diameter) and the length of the dummy half-cut was set to 50.8 mm (40% of width).

Example 8

A discontinuous half-cut was provided on the dye receiver layer of the image receiver sheet of the seal type sheet roll for thermal transfer recording ①, and a dummy half-cut was formed parallel to the width-wise direction of the half-cut. The depth of the half-cut and that of the dummy half-cut were set to 70 μm (100% of the thickness of the image receiver sheet), the distance between the half-cut and the dummy half-cut was set to 10 mm (1/1 of the smallest roll diameter) and the length of the dummy half-cut was set to 127 mm (100% of width).

Comparative Example 1

A discontinuous half-cut was provided on the dye receiver layer of the image receiver sheet of the seal type sheet roll for thermal transfer recording ①, however, no dummy half-cut was formed. At this time, the depth of the half-cut was set to 70 μm (100% of the thickness of the image receiver sheet).

Comparative Example 2

A discontinuous half-cut was provided on the dye receiver layer of the image receiver sheet of the seal type sheet roll for thermal transfer recording ①, however, no dummy half-cut was formed. At this time, the depth of the half-cut was set to 63 μm (90% of the thickness of the image receiver sheet).

Comparative Example 3

A discontinuous half-cut was provided on the dye receiver layer of the image receiver sheet of the seal type sheet roll for thermal transfer recording ①, and a dummy half-cut was provided in a direction perpendicular to the width-wise direction of the half-cut. The depth of the half-cut and that of the dummy half-cut were set to 70 μm (100% of the thickness of the image receiver sheet), the distance between the half-cut and the dummy half-cut was set to 10 mm (1/1 of the smallest roll diameter) and the length of the dummy half-cut was set to 63.5 mm (50% of width).

Evaluation

Of the seal type sheet roll for thermal transfer recordings of Examples 1 to 8 and the Comparative Examples 1 to 3, the [running performance], [peel-off properties] and the [irregularities in concentration] were valuated as now explained. The results obtained are shown in Table 2.

Running Performance

A length equal to 10 m of the seal type sheet roll for thermal transfer recording was loaded on a sublimation thermal transfer recording roll type printer (UD-DR100, manufactured by one of the present Assignee, Sony Corporation) and the running performance thereof in the printer was evaluated by ranking (○, Δ and x) under the following standard:

○: no half-cut peel-off within the printer

Δ: slight half-cut peel-off in the 10 m length of the seal type sheet roll for thermal transfer recording, but no practical problem in the running performance in the printer x: half-cut peel-off in the 10 m length of the seal type sheet roll for thermal transfer recording, there being a practical problem in the running performance in the printer Peel-Off Properties Printing was made by a printer on the seal type sheet roll for thermal transfer recording and the half-cut area thereof was peeled off manually. The resulting state was evaluated and ranked (○, Δ and x) by the following standard:

○: peeled off easily

Δ: slight resistance to peel-off, but not inconvenient for peeling x: peel-off difficult or impossible Irregularities in Concentration Using a sublimation thermal transfer recording roll type printer UP-DR100, manufactured by one of the present Assignee, Sony Corporation, and a thermal transfer recording sheet made up by dyes of yellow (Y), magenta (M) and cyan (C), and a laminated film L, manufactured by the one of the present Assignee, Sony Corporation,—printing without spaces was made on a seal type sheet for thermal transfer recording with a light gray color. The irregularities in concentration of the half-cut were evaluated and ranked (○, Δ and x) by the following standard:

○: no irregularities in concentration

Δ: slight irregularities in concentration occur but not to such an extent as to degrade the quality x: irregularities in concentration occur to degrade the quality

TABLE 2

| | test on running performance | test on peel-off | irregularities in concentration |
|---|---|---|---|
| Ex. 1 | ○ | ○ | ○ |
| Ex. 2 | ○ | ○ | Δ |
| Ex. 3 | ○ | ○ | ○ |
| Ex. 4 | ○ | ○ | ○ |
| Ex. 5 | Δ | ○ | ○ |
| Ex. 6 | Δ | ○ | ○ |
| Ex. 7 | Δ | ○ | ○ |
| Ex. 8 | Δ (dummy area) | ○ | ○ |
| Comp. Ex. 1 | x | ○ | ○ |
| Comp. Ex. 2 | ○ | x | ○ |
| Comp. Ex. 3 | x | ○ | ○ |

From the results of the Examples 1 to 8 and the Comparative Examples 1 and 2, it is seen that, by providing a dummy half-cut parallel to the half-cut provided in a direction perpendicular to the sheet feeding and ejecting direction in the printer, not only the peel-off properties and the irregularities in concentration but also the running performance may be improved.

From the results of the Examples 5 and 6, it is also seen that, if the distance between the half-cut and the dummy half-cut is outside the range of 1/1 to 1/5 of the diameter of the smallest diameter transport roll in the printer, the running performance is deteriorated. Moreover, from the results of the Examples 7 and 8, it is also seen that, if the length of the dummy half-cut is outside the range of not less than 50% and less than 100% of the width of the sheet for thermal transfer recording in the direction perpendicular to the paper sheet feeding/ejecting direction in the printer, the running performance tends to be lowered.

From the results of the Comparative Example 3, it is seen that, when the dummy half-cut is provided at right angles to the width-wise length of the half-cut, the running performance is not improved.

With the image receiver material of the present invention, the two requirements of [easy peeling of the image receiver sheet, having the image formed therein after transfer recording, from the separator] and [prevention of peel-off of the half-cut otherwise produced under a load stress ascribable to toughness of the thermal transfer recording sheet wound on a roll of a small diameter in the printer during the process of sheet feed and sheet eject process steps before and after transfer recording] may be satisfied simultaneously.

What is claimed is:

1. An image receiver material comprising:

a separator including a release sheet base material and a release agent layer provided over one surface thereof; and an image receiver sheet including a receiver sheet base material and an adhesive layer provided over one surface thereof; wherein said separator and the image receiver sheet are releasably attached to each other, with the release agent layer of said separator facing the adhesive layer of said image receiver sheet;

said image receiver sheet being provided with a half-cut in a direction substantially perpendicular to a feed/eject direction for a paper sheet of the image receiver material in a printer, and with a stress relaxing means formed adjacent said half-cut in said feed/eject direction.

2. The image receiver material according to claim 1, wherein said stress relaxing means is a dummy half-cut provided substantially parallel to said half-cut and provided in a direction substantially perpendicular to the feed/eject direction.

3. The image receiver material according to claim 1 or 2, wherein the depths of said half-cut and the dummy half-cut are 100 to 150% of the thickness of the image receiver sheet; and wherein a width of said dummy half-cut is at least 40% of the width of the image receiver sheet.

4. The image receiver material according to any one of claims 1 to 3, wherein a dye receiver layer for receiving a dye transferred upon being melted or sublimated by heat, or an ink receiver layer for receiving an ink, is formed over a surface of the image receiver sheet opposite to said adhesive layer of the image receiver sheet.

5. An image receiver material of the seal type comprising:

a separator including a release sheet base material and a release agent layer provided over one surface thereof; and an image receiver sheet including a receiver sheet base material and an adhesive layer provided over one surface thereof; wherein said separator and the image receiver sheet are releasably attached to each other with the release agent layer of said separator facing the adhesive layer of said image receiver sheet;

said image receiver sheet being provided with a half-cut in a direction substantially perpendicular to the feed-ieject direction for a paper sheet of the image receiver material in a printer, and with a dummy half-cut substantially parallel to said half-cut, the distance between said half-cut and the dummy half-cut being 2/1 to 1/10 of a roll diameter of a smallest transport roll of said printer.

6. The image receiver material according to claim 5, wherein the depth of each of said half-cut and the dummy half-cut is 100 to 150% of the thickness of the image receiver sheet; and wherein the width of said dummy half-cut is at least 40% of the image receiver sheet.

7. The image receiver material according to claim 5 or 6, wherein a dye receiver layer receiving a dye melted or sublimated by heat, or an ink receiver layer for receiving an ink, is formed over a surface of said image receiver sheet opposite to said adhesive layer of the image receiver sheet.

8. The image receiver material according to claim 1, wherein said stress relaxing means comprises a dummy half-cut.

9. The image receiver material according to claim 1, wherein said stress relaxing means comprises a dummy quarter-cut.

10. The image receiver material according to claim 1, wherein said stress relaxing means comprises perforations.

11. The image receiver material according to claim 1, wherein said stress relaxing means comprises a skim.

* * * * *